United States Patent [19]

LeBlanc et al.

[11] Patent Number: 4,558,627

[45] Date of Patent: Dec. 17, 1985

[54] WEAPON CONTROL SYSTEM

[75] Inventors: James C. LeBlanc; Richard S. LeBlanc, both of Mt. Clemens, Mich.

[73] Assignee: General Motors Corporation, Detroit, Mich.

[21] Appl. No.: 655,262

[22] Filed: Sep. 27, 1984

Related U.S. Application Data

[63] Continuation of Ser. No. 437,855, Oct. 29, 1982, abandoned.

[51] Int. Cl.[4] ..... F41G 5/02

[52] U.S. Cl. ..... 89/41.03; 89/41.02; 89/41.12; 318/592

[58] Field of Search ..... 89/41.02, 41.03, 41.04, 89/41.12; 318/592, 595, 597, 648, 663

[56] References Cited

U.S. PATENT DOCUMENTS

| | | | |
|---|---|---|---|
| 2,408,069 | 9/1946 | Hull et al. | 89/41.12 |
| 2,414,690 | 1/1947 | Edwards | 89/41.04 |
| 2,548,884 | 4/1951 | Hartman et al. | 89/41.12 |
| 2,938,435 | 5/1960 | Gille | 89/41.12 |
| 2,948,193 | 8/1960 | Leathers et al. | 89/41.12 |

*Primary Examiner*—Stephen C. Bentley
*Attorney, Agent, or Firm*—Mark A. Navarre

[57] ABSTRACT

The disclosure relates to an electronic and hydraulic control system to provide variable speed capability for moving a weapon system carried on an armored vehicle. A weapon system is mounted on a turret assembly for movement in the azimuth and elevation directions. Hydraulic motors and piston-cylinder arrangements actuated by a variable electronic control system are employed to drive the weapon system. Through the desired path the control system permits the weapon system to be driven in two ranges, a normal range which is variable and a high speed range which is constant to provide quick motion to a target when needed.

4 Claims, 1 Drawing Figure

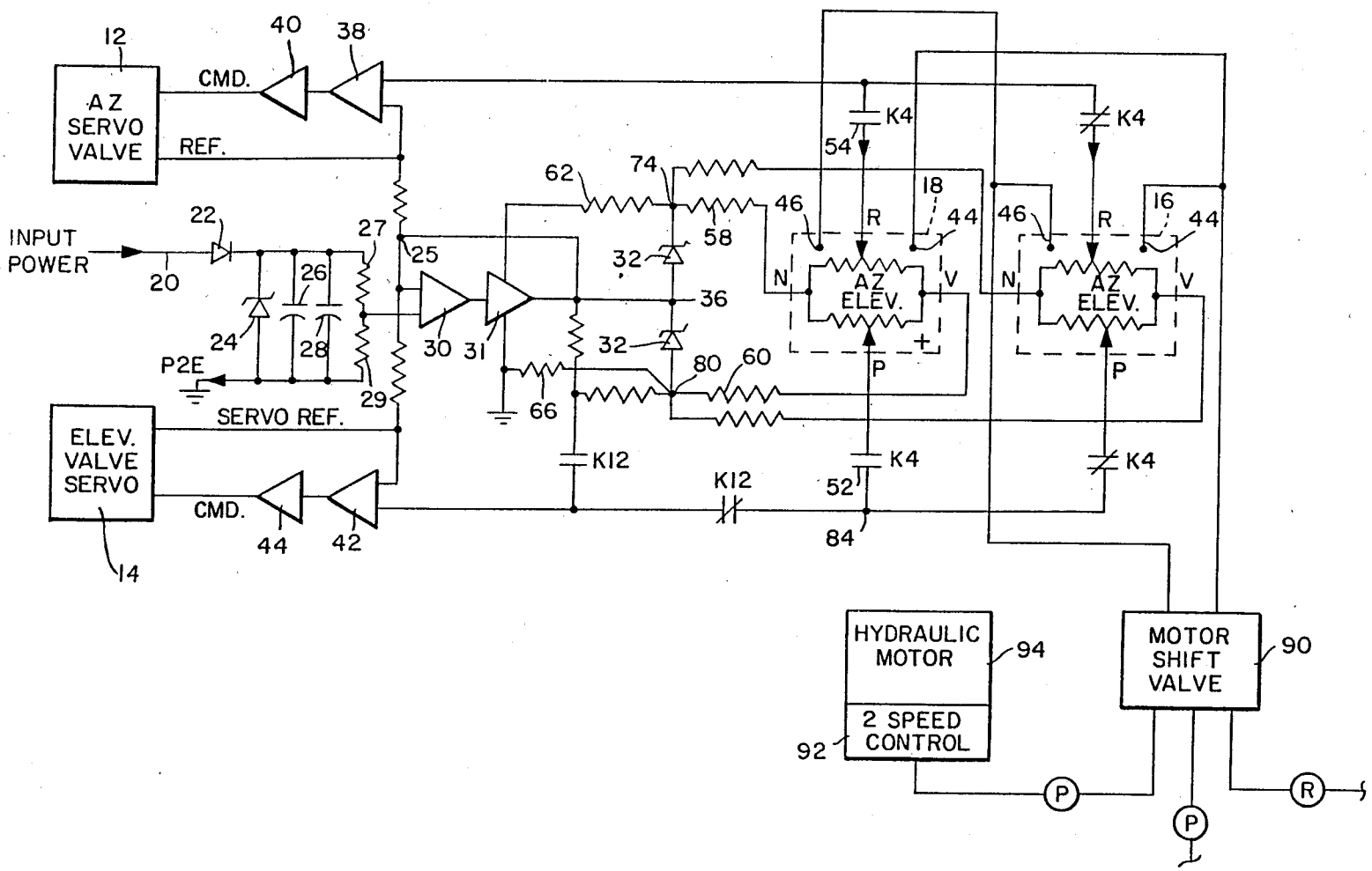
MOTOR SHIFT VALVE
HYDRAULIC MOTOR
2 SPEED CONTROL
AZ ELEV.
AZ SERVO VALVE
ELEV. VALVE SERVO
CMD.
REF.
SERVO REF.
INPUT POWER
P2E
K4
K12

WEAPON CONTROL SYSTEM

This is a continuation of co-pending application Ser. No. 437,855 filed on Oct. 29, 1982, now abandoned.

BACKGROUND AND DISCUSSION OF THE INVENTION

The invention relates to a weapon system carried on an armored vehicle for movement in the azimuth and elevation directions. Hydraulic motors and piston cylinder arrangements are employed in conjunction with an electronic control system to drive the turret assembly on which the weapon system is mounted through an azimuth or an arc in one plane, and a piston cylinder arrangement drives the weapon systems in the elevation, in a plane substantially perpendicular to the azimuth. As decribed in the detailed embodiment which follows hereinafter, a unique feature of the invention is the ability to control the speed and direction in which the weapon system is moved in the azimuth or the elevation in directing the weapon to the target.

An important consideration in weapon systems is the varying the speed with which the weapon is moved toward the target. Once the target is sighted it is initially desired depending on the the position of the weapon to move the weapon quickly toward the target. However, as the weapon system approaches the target, it is desirable to reduce the speed of the weapon system until the target position is reached. Often weapon systems of the past have not included this type of variable control and have resulted in overshoot and other inaccuracies and inefficiencies in moving the weapon systems through a tracking operation.

In the invention described herein, a servo valve sensitive to an electrical signal controls the delivery of hydraulic fluid to a piston-cylinder, hydraulic motor or other driving means to move these motors at a rate corresponding to the signal being delivered. Thus, where a relatively high current is moving through the servo valve the movement of the weapon systems will be at relatively high speed and as the current approaches zero the speed will be reduced accordingly toward zero. With regard to the azimuth drive system there is a two-speed motor incorporated in the system and connected to the electronic control for actuation by a relay. When the relay is tripped for a maximum speed, the displacement of the motor will be decreased so that it can move much more quickly than before. This provides a higher speed range for the control which is desirable where the weapon needs to be moved as quickly as possible to the target from a relatively remote position. Once the target is approached, the hydraulic motor can be shifted down to the range for normal operation.

The above has been a general description of some deficiencies which have existed before and some features of the invention. A more detailed description of the invention follows hereinafter and additional advantages can be appreciated from this description.

BRIEF DESCRIPTION OF THE DRAWING

FIG. 1 is a schematic of the electrical circuit diagram and hydraulic system of the control system.

A DETAILED DESCRIPTION OF THE PREFERRED EMBODIMENT

As can be seen from FIG. 1, the control system of the invention includes two potentiometers 16 and 18 arranged in parallel with one another and conntected through relay K4 for switching between the potentiometers depending on personnel operating the system. In the armored vehicle contemplated, typically there will be two persons located in the turret for operating various elements of the weapon systems in the vehicle, for example, a commander and a gunner. As a matter of convenience, potentiometer 18 will be referred to as the commander's hand control and potentiometer 16 will be referred to as the gunner's hand control. As the circuit is substantially the same for either the commander's hand control or the gunner's hand control, it will be described in connection with only the commander's hand control, which control is connected to the remainder of the system through the contacts 52 and 54 of relay K4.

Input 20 is provided from a battery or alternating power source within the vehicle. The input is delivered through diode 22 in parallel with a zener diode 24, parallel capacitors 26 and 28, to resistors 27 and 29. The input to the two stage amplifier 30 and 31 is obtained at a terminal between resistors 27 and 29. A feedback loop to the first stage of the amplifier 30 is made terminal 25. The output of amplifier 30 is connected to the input of amplifier 31 which in turn at terminal 74 is connected through resistors 62 and at terminal 80 is connected through resistor 66. The output of this latter amplifier 31 is connected at terminal 36 which through to zener diodes 32 is connected on either side of the potentiometer 18 at terminals N and V, through resistors 58 and 60, respectively.

The variable potentiometer for the azimuth includes variable terminal R connected through relay contact 54 to azimuth output amplifiers 38 and 40 to amplify the signal to the azimuth servo valve 12 as shown. Similarly, the elevation potentiometer connected through the variable terminal P and relay contact 52 is connected to a two stage amplifier 42 and 44 for amplifying the signal to elevation servo valve 14.

As is well known, the position of the potentiometer determines the amplitude and direction of current delivered to the amplifiers 38 and 40, 42 and 44, for controlling the azimuth and elevation servo valves, respectively. As the resistance becomes lower as a function of the position of the terminal P or R the output current becomes greater driving the servo valves into a position where greater fluid flow is allowed to whatever motor means is being employed. As arranged on the actual stick employed by the operator, movement to the left or the right or forward to the aft away from the center or null position results in increased current to the servo valve and greater movement of the weapon system in the azimuth or elevation.

For example, for azimuth control, if a joy stick is moved to the right, the current will approach its maximum value driving the servo valve to an open position such that the azimuth hydraulic motor will be operating at its higher rate within a given range to move the turret rotation at or toward maximum speed. On movement to the left from null the same thing will occur except in the direction opposite to that described above. Similarly, as the joy stick is moved forward, the greater distance in elevation away from the null, the more quickly the gun will be depressed. And as the joy stick is moved toward the null position between the fore and aft the weapon will move more slowly and elevation until the zero point is reached in which the gun will of course not be moved at all. The relay K4 can be actuated to effect predetermined movement of the elevational servo 14. This operation is independent and to the exclusion of the potentiometers 16 and 18.

In addition to the electronic system described above, there is also employed with the azimuth drive control relays 46 and 44 for the commander's hand control and gunner's hand control, operating another servo valve referred to herein as the motor shift valve 90. The shift valve 90 controls the delivery of pressurized hydraulic fluid to a two-speed control 92 of motor 94 to shift the hydraulic motor employed between two ranges of operation. One, a relatively low range and higher displacement when compared to the higher range and lower displacement which allows the hydraulic motor to move the weapon system at two different speeds. Once the joy stick is moved completely to the left or the right as far from null as allowed by the mechanical operation, relays 44 and 46 of the selected hand control will be actuated, causing the motor shift valve to effect movement of the two-speed control 92 of the hydraulic motor to a higher range. This decreases the displacement of the motor driving the weapon systems through the azimuth such that it moves much more quickly than in the first range. This additional feature provides the capability to move the weapon extremely quickly through azimuth until it approaches the target. As target is approached, the joy stick can be moved away from its extreme position either left or right toward the null position shifting the hydraulic motor back into the first range of normal operation.

The above has been a detailed discussion of the preferred embodiment of the invention and should not be interpreted to limit the full scope of the invention. The claims which follow more clearly define the scope of the invention along with all equivalents.

We claim:

1. A system for controlling movement of a weapon comprising:

control means including a multispeed range fluid operated motor for effecting movement of the weapon and an electrically operated fluid servo positionable in relation to the magnitude and direction of electric current supplied thereto for supplying fluid to said motor to control the direction of speed of weapon movement;

demand means including a positionable potentiometer and amplifier means for supplying said servo with electric current of a magnitude and direction for bringing the position of the servo into correspondence with the position of the potentiometer;

manually operated means for adjusting the potentiometer between null and limit positions to control the speed and direction of weapon movement; and motor speed range control means effective (1) when the potentiometer position is adjusted to a nonlimit position by said manually operated for engaging a first speed range of said motor to effect relatively slow movement of said weapon, and (2) when the potentiometer position is adjusted to a limit position by said manually operated means for engaging a second speed range of said motor to effect relatively rapid movement of said weapon.

2. The system according to claim 1 wherein there are separate control means for effecting azimuth and elevational movements of said weapon, and said potentiometer includes an azimuth variable resistor and an elevational variable resistor connected in parallel at a first terminal and a second terminal, the input to said first and second terminals being connected across two serially connected Zener diodes, the elevational variable resistor of said potentiometer being connected to amplifier means associated with the elevational servo and the azimuth variable resistor of the potentiometer being connected to amplifier means associated with the azimuth servo.

3. The system according to claim 2, wherein a further potentiometer is connected in parallel with the said potentiometer and connected to said elevational servo and azimuth servo by a relay switch.

4. The system according to claim 3 further comprising two relays located at each end of the variable resistor for actuation through movement of the manually operated means to a limit position, said relay being connected to a motor displacement shift valve in an operative position, said motor displacement shift valve being connected to a two-speed range control of the fluid operated motor, said two-speed control having two modes of operation, a normal mode and a high speed mode, said motor displacement valve when actuated by a signal from said relay means on said azimuth potentiometer driving said motor displacement shift valve between said two modes of operation.

* * * * *